US005277416A

United States Patent [19]

Kim

[11] Patent Number: 5,277,416

[45] Date of Patent: Jan. 11, 1994

[54] DEVICE FOR FEEDING PAPER INTO A FACSIMILE SYSTEM, COPY MACHINE OR OTHER DEVICE

[75] Inventor: Hyoung-Chae Kim, Ahnyang, Rep. of Korea

[73] Assignee: SamSung Electronics Co., Ltd., Suwon, Rep. of Korea

[21] Appl. No.: 485,490

[22] Filed: Feb. 27, 1990

[30] Foreign Application Priority Data

Feb. 28, 1989 [KR] Rep. of Korea ..... 19892472

[51] Int. Cl.[5] ..... B65H 3/06

[52] U.S. Cl. ..... 271/119; 271/121

[58] Field of Search ..... 271/119, 109, 121; 221/259

[56] References Cited

U.S. PATENT DOCUMENTS

| | | | |
|---|---|---|---|
| 175,487 | 3/1876 | Myers | 271/121 |
| 1,072,846 | 9/1913 | Goodridge | 271/121 |
| 2,614,837 | 10/1952 | Cuthbert, Jr. | 271/121 |
| 2,726,862 | 12/1955 | Anderson | 271/124 |
| 2,779,593 | 1/1957 | Doerner | 271/121 |
| 4,239,709 | 12/1980 | Hunt | 271/121 X |
| 4,269,403 | 5/1981 | Stephans et al. | 271/121 X |
| 4,368,880 | 1/1983 | Shimizu | 271/121 |
| 4,635,922 | 1/1987 | Roetter et al. | 271/121 X |
| 4,718,655 | 1/1988 | Okayama et al. | 271/121 X |
| 4,775,140 | 10/1988 | Foster | 271/121 |
| 4,861,013 | 8/1989 | Shibata et al. | 281/121 X |
| 4,865,306 | 9/1989 | Himegi | 271/121 |
| 4,887,806 | 12/1989 | Tanaka et al. | 271/121 |
| 4,895,358 | 1/1990 | Kawasaki | 271/121 |
| 4,915,372 | 4/1990 | Kano et al. | 271/121 X |

FOREIGN PATENT DOCUMENTS

| | | | |
|---|---|---|---|
| 48809 | 9/1988 | Fed. Rep. of Germany | 271/119 |
| 48704 | 4/1987 | France | 271/121 |
| 48407 | 7/1984 | Japan | 271/121 |
| 48601 | 1/1986 | Japan | 271/121 |
| 48604 | 4/1986 | Japan | 271/109 |
| 0166440 | 7/1986 | Japan | 271/124 |
| 48804 | 4/1988 | Japan | 271/121 |
| 48911 | 11/1989 | Japan | 271/121 |

*Primary Examiner*—H. Grant Skaggs
*Assistant Examiner*—Carol Lynn Druzbick
*Attorney, Agent, or Firm*—Robert E. Bushnell

[57] ABSTRACT

There is disclosed a device for feeding a number of stacked documents accurately one by one into a machine such as a copy machine or facsimile including a table for loading the stacked documents, a pick-up roll for picking up the lowermost document of the stacked documents, and a pick-up rubber for cooperating with the pick-up roll so as to only convey the lowermost document into the machine. The free end portion of the pick-up rubber is pressed against a portion of the surface of the pick-up roll by a compression spring via a pressure plate. There are at least one pair of protrusions each positioned on one end portion of the circumferential surface of the pick-up roll and symmetrically facing each other along a line parallel with the axis of the pick-up roll.

14 Claims, 3 Drawing Sheets

DEVICE FOR FEEDING PAPER INTO A FACSIMILE SYSTEM, COPY MACHINE OR OTHER DEVICE

TECHNICAL BACKGROUND

The present invention generally concerns a paper feeder for use in an office automation (O/A) system such as a copying machine or a facsimile system and, more particularly, a device for feeding stacked documents accurately one by one.

FIG. 1 illustrates a conventional document feeding device for a facsimile, the device comprises a table 11 for loading the stacked documents, 20 a pick-up roll 12 for picking up the lowermost document of the stacked documents, and a pick-up rubber 14 for cooperating with the pick-up roll 12 so, as to only convey the lowermost document into the facsimile. The free end portion of the pick-up rubber 14 is pressed against a portion of the surface of the pick-up roll 12 by a compression spring 13 via a pressure plate 16. Under the pressure plate 16 is fixedly mounted plate spring 15, whose end portion is smoothly curved up-wardly. The underside of the curved portion of the plate spring 15 contacts the circumferential surface of the pick-up roll 12 at a point thereof.

In feeding the documents, the stacked documents on the table 11 approach separating position B, the approach is sensed by a sensing device (not shown), and thus, the pick-up roll 12 is driven to convey the lowermost document of the stacked documents. The leading end of the conveyed document approaches the separating position B after passing under the plate spring 15, and therefore, the frictional force between the document and the surface of the pick-up roll 12 is increased over that when the document simply contacts the separating position B. Thus, as the contact are between the document and the pick-up roll 12 is increased so as to increase the frictional force, the paper feeder correspondingly ensures the document conveying. In this case, the front surface of the document contacts the pick-up roll 12, while the back surface of the document contacts the pick-up rubber 14. Thus, the front surface of the document contacts the pick-up roll 12 from position A, while the back surface of the document contacts the pick-up rubber 14 from position B. Consequently, the frictional force between the document and the pick-up roll 12 becomes greater than that between the document and the pick-up rubber 14, so that the document just contacting the pick-up roll 12 may be conveyed forwardly, and the remaining documents are prevented from being conveyed just before the separating position B.

When the leading end of the document passing the separating position B passes under the plate spring 15, the contact between the document and the pick-up roll 12 is more improved, thereby more ensuring the document conveying. Thus, the documents are sequentially conveyed one by one by the rotation of the pick-up roll 12.

In such a conventional document feeding device, the document feeding condition is influenced by the kind, size and number of the documents, and the frictional force between the documents and the pick-up rubber 14 is influenced by the temperature and humidity of the surrounding atmosphere, so that the document conveying frequently experiences poor conditions Moreover, long use of the pick-up roll 12 results in changes in the frictional coefficient of the roll and the hardness of the roll material, thereby deteriorating the document feeding

SUMMARY OF THE INVENTION

It is an object of the present invention to provide a device for precisely moving the stacked documents to the separating position in a paper feeding device.

According to the present invention, a device for feeding a number of stacked documents one by one into a facsimile machine, a copy machine or other device includes a table for loading the stacked documents, a pick-up roll for picking up the lowermost document of the stacked documents, and a pick-up rubber for cooperating with the pick-up roll so as to only convey the lowermost document into the machine, the free end portion of the pick-up rubber being pressed against a portion of the surface of the pick-up roll by a compression spring via a pressure plate, characterized in that there are at least a pair of protrusions each positioned on one end portion of the circumferential surface of the pick-up roll and symmetrically facing each other along a line parallel with the axis of the pick-up roll.

Other objects and further features of the present invention will be apparent from the following detailed description with respect to the preferred embodiments of the invention when read in conjunction with the accompanying drawings.

BRIEF DESCRIPTION OF THE DRAWINGS

For a better understanding of the invention and to show how the same may be carried into effect, reference will now be made, by way of example, to the accompanying drawings, in which.

DETAILED DESCRIPTION OF THE PREFERRED EMBODIMENT

The present invention will now be described more specifically with respect to the drawings, only by way of example.

Figure 1:
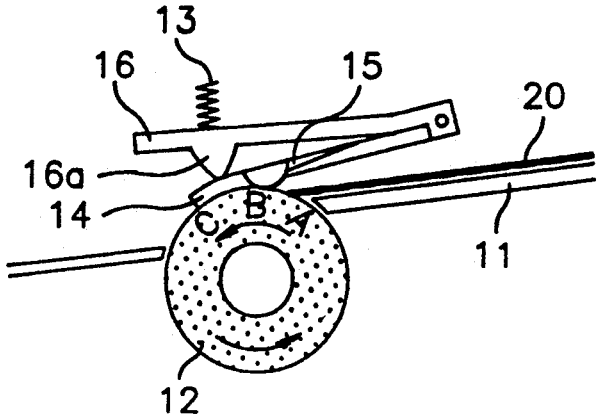
(PRIOR ART) FIG. 1
FIG. 1 is a schematic side view of the structure of a conventional document feeding device.
Figure 2:
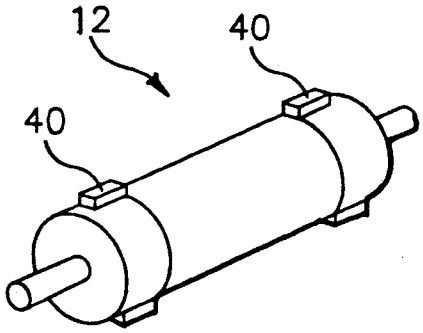
FIGS. 2 and 6 are perspective views of a pick-up roll according to the present invention.
Figure 3:
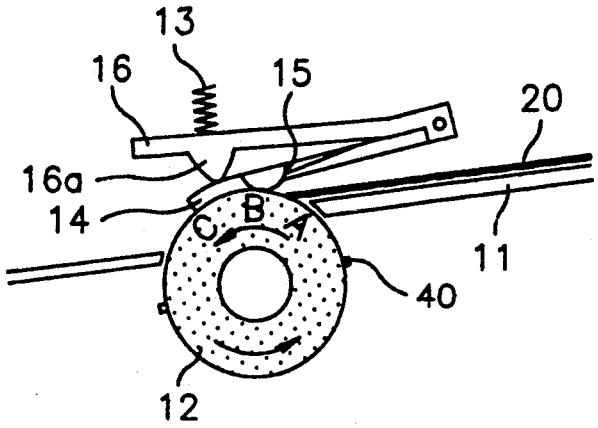
FIG. 3 is a schematic structural side view of the inventive document feeding device.
Figure 4A:
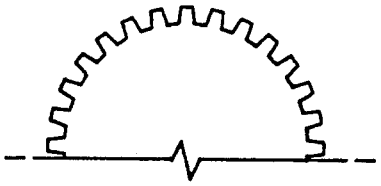
FIG. 4A–4D are end views of a pick-up roll having protrusions formed thereon, embodied according to the present invention.
Figure 4B:
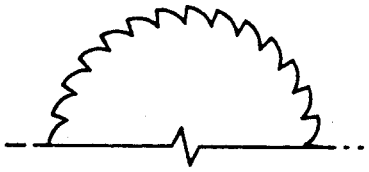
Figure 4C:
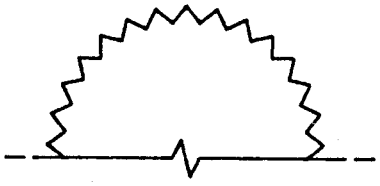
Figure 4D:
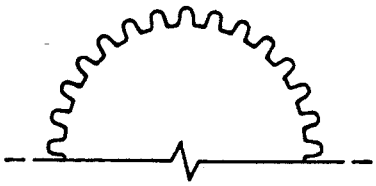
Figure 5A:
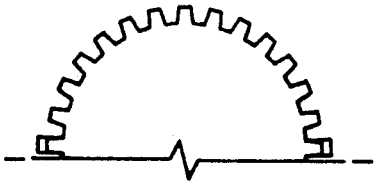
FIGS. 5A–5D are end views of the pick-up rolls having grooves formed thereon, embodied according to the present invention.
Figure 5B:
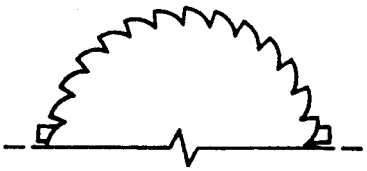
Figure 5C:
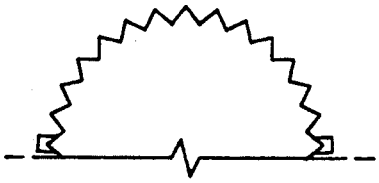
Figure 5D:
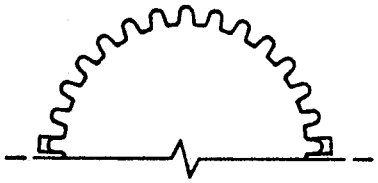
Figure 6:
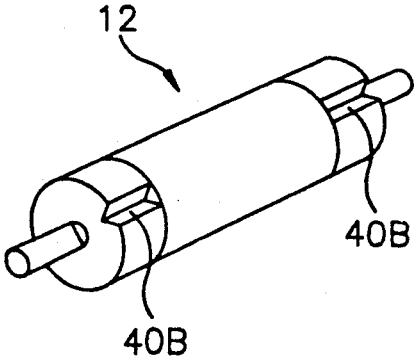

Referring to FIG. 3, the inventive device comprises a table 11 for loading stacked documents, 20 a pick-up roll 12 for picking up the lowermost document of the stacked documents, and a pick-up rubber 14 for cooperating with the pick-up roll so as to only convey the lowermost document into a machine. The free end portion of the pick-up rubber 14 is pressed against a portion of the surface of the pick-up roll 12 by a compression spring 13 via a pressure plate 16. In addition, there are formed at least a pair of protrusions 40 each positioned on one end portion of the circumferential surface of the pick-up roll 12 and symmetrically facing each other along a line parallel with the axis of the pick-up roll.

In operation, the stacked documents 20 are set on the table 11 mounted on a facsimile or other machine (not shown), and are sensed by a document sensor to drive the pick-up roll 12. The leading end of the documents stacked on the table 11 contacts the pick-up roll 12 which drives the documents to document separating position B from document conveying interval A. In this case, the protrusions 40 formed on both end portions of the pick-up roll 12 push the documents 20 upwardly in the interval AB, thereby ensuring effective conveyance of the document in the interval AB.

The shape and number of the protrusions 40 may be suitably determined according to the facsimile or other machine used. When the documents 20 are moved to the position B from the position A, the plate spring 15 is raised by the protrusions 40 so as to interpose the documents 20 between the spring 15 and the pick-up roll 12. Specifically, the documents 20 set on the table 11 are conveyed by the frictional force between the protrusions 40 and the documents 20 in the interval AB, since they are interposed between the spring 15 and the pick-up roll 12 after passing the position B, they are ensured to be conveyed into the interval BC. Thus, the documents 20 are interposed between the pick-up roll 12 and the pick-up rubber 14 under pressure, because the free end portion of the rubber 14 is urged toward the surface of the pick-up roll 12 by the compression spring 13 via the pressure plate 16. Consequently, only the lowermost document contacting the pick-up roll 12 is conveyed because the remaining documents experience the frictional forces between them, or between them and the pick-up rubber 14.

The shape of the protrusions formed on both end portions of the pick-up roll 12 may have various forms as shown in FIGS. 4A–4D, or otherwise, instead of the protrusions, grooves 30 of various forms may be made in both end portions of the pick-up roll, as shown in FIGS. 5A–5D and FIG. 6. Then, the documents 20 may be inserted into the grooves of the rotating pick-up roll 12. Subsequently, the document 20 contacts the edge of a groove positioned in the rotational direction of the pick-up roll 12, thereby being raised slightly, so that the lowermost document contacts the roll surface over a relatively wide area, increasing the frictional force between the pick-up roll 12 and the document. Hence, only the lowermost document is conveyed. In this case, the frictional force between the pick-up roll 12 and the conveyed document is designed to be greater than the sum of the frictional force between the documents and greater than that between the document and the pick-up rubber 14, and in addition, greater than that between the document and the table 11. Reiterating, the documents 20 are pressed between the pick-up rubber 14 and the pick-up roll 12 by the cooperation of the spring 13 and the pressure plate 16, so that only the lowermost document just contacting the pick-up roll 12 is conveyed.

As described above, the inventive document feeding device for a facsimile causes the documents on the loading table to be easily moved to the document separating position, thereby improving reliability of the machine.

While the invention has been particularly shown and described with reference to a preferred embodiment , it will be understood by those skilled in the art that modifications in detail may be made without departing from the spirit and scope of the invention.

What is claimed is:

1. A device for feeding a number of stacked documents seriatim into a machine, said device comprising:

means for supporting a stack formed by said stacked documents;

pick-up means for separating said stacked documents;

a roll for contacting a lowermost one of said stacked documents and for conveying at least one of said stacked documents between said roll and said pick-up means while said pick-up means mechanically cooperates with said roll by impeding the conveyance of all but said lowermost one of said stacked documents into said machine;

means for biasing said pick-up means towards said roll, whereby a first portion of said pick-up means is pressed against a portion of the surface of said roll by said biasing means; and at least two pairs of protrusions, each of said pairs of protrusions being positioned on axially opposite end portions of said roll and each protrusion of said pairs of protrusions extending radially outwardly from the circumferential surface of said roll along a diametrical line perpendicular to the axis of said roll.

2. The device as claimed in claim 1, wherein said protrusions are semi-circular.

3. The device as claimed in claim 1, wherein one side of said protrusion is perpendicular to said roll axis, and the other side is curved backwards in the form of a saw tooth.

4. The device as claimed in claim 1, wherein said protrusions slope towards both sides in a triangular form.

5. The device as claimed in claim 1, wherein said protrusions are cycloid.

6. The device of claim 1, wherein said protrusions are involute.

7. A device for feeding a number of stacked documents one by one into a machine, said device comprising:

means for supporting a stack formed by the stacked documents;

separating means for separating said documents from the stack; and a pick-up roll exhibiting a circumferential exterior surface for contacting the lowermost one of said documents in said stack and for conveying at least one of said stacked documents between said separating means and said pick-up roll said separating means cooperating with said pick-up roll for impeding the conveyance of all but said lowermost one of said documents into said machine;

means for biasing a first face portion of said separating means against a portion of the surface of said pick-up roll; and axially opposite end portions of the circumferential surface of said pick-up roll containing a pair of groves with each groove of said pair of grooves extending diametrically inwardly from the circumferential exterior surface of said pick-up roll, with each groove in one axially opposite end portion being symmetrically aligned along a line parallel to the axis of said pick-up roll with a corresponding groove in the other axially opposite end portion.

8. The device as claimed in claim 7, wherein said groves are cycloid.

9. The device as claimed in claim 8, wherein one side of a plurality of said groves is perpendicular to said axis, and the other side is sloped backwards in the form of a saw-tooth.

10. The device as claimed in claim 7, wherein said groves slope towards both sides in a triangular form.

11. The device as claimed in claim 7, wherein said grooves are semi-circular.

12. The device of claim 7, wherein said grooves are involute.

13. A device for serially feeding stacked documents into a machine, said device comprising:

means for supporting a stack formed by said stacked documents;

pick-up means for separating said documents; and a pick-up roll for contacting a lowermost one of said documents in said stack and for conveying said lowermost one of said stacked documents between said pick-up roll and said pick-up means while said pick-up means mechanically cooperates with said pick-up roll by impeding the conveyance of all but said lowermost one of said documents into said machine;

means for biasing said pick-up means towards said pick-up roll, with a first portion of said pick-up means being urged against a portion of the surface of said pick-up roll by said biasing means; and a plurality of protrusions arranged in diametrically opposite pairs, each pair of said protrusions being positioned on axially opposite end portions of said pick-up roll and each of said protrusions extending radially outwardly from the circumferential surface of said pick-up roll.

14. A device for feeding a number of stacked documents one by one into a machine, said device comprising:

means for supporting a stack formed by the stacked documents;

separating means for separating said documents from the stack; and a pick-up roll providing a right circular cylindrical form having a circumferential exterior surface for contacting the lowermost one of said documents in said stack and for conveying at least one of said stacked documents between said separating means and said pick-up roll wherein said separating means cooperates with said pick-up roll for impeding the conveyance of all but said lowermost one of said documents into said machine;

means for biasing a first face portion of said separating means against a portion of the surface of said pick-up roll; and axially opposite end portions of the circumferential surface of said pick-up roll containing at least a pair of grooves extending diametrically inwardly from the circumferential surface of said pick-up roll, with each groove in one axially opposite end portion being symmetrically aligned along a line parallel to the axis of said pick-up roll with a corresponding groove in the other axially opposite end portion.

* * * * *

UNITED STATES PATENT AND TRADEMARK OFFICE

CERTIFICATE OF CORRECTION

PATENT NO. : 5,277,416
DATED : Jan. 11, 1994
INVENTOR(S) : Hyoung–Chae Kim

It is certified that error appears in the above-indentified patent and that said Letters Patent is hereby corrected as shown below:

| | | |
|---|---|---|
| Column 1, | Line 14, | after "stacked", change"documents, 20" to --documents 20,--; |
| | Line 17, | between "so" and "as", delete ","; |
| Column 2, | Line 46, | after "grooves", insert --and protrusions--; and |
| | Line 55, | after "stacked", change"documents, 20" to --documents 20,--: |

Signed and Sealed this
Eighth Day of July, 1997

Bruce Lehman

*Attest:*

BRUCE LEHMAN

*Attesting Officer*

*Commissioner of Patents and Trademarks*